US009796013B1

(12) United States Patent
Yang

(10) Patent No.: US 9,796,013 B1
(45) Date of Patent: Oct. 24, 2017

(54) TOOL HOLDE PANEL MOUNTING STRUCTURE FOR SPRING MAKING MACHINE

(71) Applicant: PLUSPRINGS MACHINERY CO., LTD, New Taipei (TW)

(72) Inventor: Ching-Fa Yang, New Taipei (TW)

(73) Assignee: PLUSPRINGS MACHINERY CO., LTD, Taipei (TW)

( * ) Notice: Subject to any disclaimer, the term of this patent is extended or adjusted under 35 U.S.C. 154(b) by 0 days.

(21) Appl. No.: 15/224,552

(22) Filed: Jul. 31, 2016

(51) Int. Cl.
*B21F 35/00* (2006.01)
*B21F 3/02* (2006.01)

(52) U.S. Cl.
CPC ..... *B21F 35/00* (2013.01); *B21F 3/02* (2013.01)

(58) Field of Classification Search
CPC .... B21F 1/00; B21F 1/008; B21F 3/00; B21F 3/02; B21F 3/06; B21F 35/00
USPC ..... 140/102, 103
See application file for complete search history.

(56) References Cited

U.S. PATENT DOCUMENTS

| | | | | |
|---|---|---|---|---|
| 7,107,806 | B2 * | 9/2006 | Tsuritani | B21F 3/02 72/135 |
| 8,166,786 | B2 * | 5/2012 | Speck | B21F 1/00 72/137 |
| 8,302,443 | B2 * | 11/2012 | Tsuritani | B21F 3/02 29/33 F |
| 8,307,683 | B2 * | 11/2012 | Jung | B21F 35/00 72/142 |
| 8,424,352 | B2 * | 4/2013 | Jung | B21F 35/00 140/103 |
| 8,573,014 | B2 * | 11/2013 | Tsuritani | B21F 3/02 72/135 |
| 2011/0114217 | A1 * | 5/2011 | Wu | B21F 3/02 140/71 C |
| 2016/0332212 | A1 * | 11/2016 | Yang | B21F 35/00 |

* cited by examiner

*Primary Examiner* — Shelley Self
*Assistant Examiner* — Pradeep C Battula

(57) ABSTRACT

A tool holder configuration structure for spring making machine includes a flat base plate and three displacement mechanisms arranged on the front side in a triangle, each displacement mechanism including a first sliding tract set and a second sliding tract set arranged at right angles, and three tool holder panels each said tool holder panel including a base, a first tool holder located on one side of the base and two second tool holders obliquely disposed at two opposite lateral sides of the first tool holder. The tool holder panels are respectively coupled to the second sliding tract sets of the displacement mechanisms to keep the first tool holders adjacent to one another so that the moving distance of the tool holder panels can be minimized and a large number of tools can be installed in each tool holder panel.

4 Claims, 6 Drawing Sheets

TOOL HOLDE PANEL MOUNTING STRUCTURE FOR SPRING MAKING MACHINE

BACKGROUND OF THE INVENTION

1. Field of the Invention

The present invention relates to spring making machine technology and more particularly, to a tool holder configuration structure for spring making machine, which minimizes the traveling distance of the tool holder panels and allows installation of a large number of tools in each tool holder pane.

2. Description of the Related Art

Many advanced spring making machines are known. For example, U.S. Pat. No. 8,166,786 B2 discloses a wire-forming machine, which comprises a machine frame, a wire feeder and a wire guide for transporting wire to a working area of the machine where the wire is processed by one or more tools. The tools are affixed on a tool plate on the machine frame and around a recess formed in the plate. A wire is fed through the recess to the working area of the machine.

In existing spring making machines, tools are carried on a tool holder plates and moved with the tool holder plates to process a metal wire into springs. The tool holder plates of a spring making machine are rectangular plates, having only one side thereof disposed to face toward the wire guide of the spring making machine. A rectangular tool holder plate simply allows installation of a limited number of tools, and thus, the operator needs to frequently replace the tools. Further, when multiple rectangular tool holder plates are installed in a spring making machine, these tool holder plates cannot be disposed close to one another to avoid impact. In consequently, the traveling distance of the tool holder plates is relatively increased. Therefore, regular spring making machines are simply equipped with two tool holder plates for carrying a limited number of tools.

SUMMARY OF THE INVENTION

The present invention has been accomplished under the circumstances in view. It is therefore the main object of the present invention to provide a tool holder configuration structure for spring making machine, which minimizes the traveling distance of the tool holder panels and allows installation of a large number of tools in each tool holder pane.

To achieve this and other objects of the present invention, a tool holder configuration structure is used in a spring making machine, comprising a flat base plate and three tool holder panels. The flat base plate has three displacement mechanisms arranged on the front side thereof in a triangle. Each said displacement mechanism comprises a first sliding tract set, and a second sliding tract set connected to the first sliding tract set at right angles. Further, two displacement mechanisms of the three displacement mechanisms are arranged at two opposite lateral sides to face each other; the other displacement mechanism of the three displacement mechanisms is arranged at the top side and equally spaced from the two laterally arranged displacement mechanisms. Each tool holder panel comprises a base, a first tool holder located on one side of the base, and two second tool holders located on the base at two opposite lateral sides of the first tool holder in an oblique manner relative to the first tool holder. The tool holder panels are respectively coupled to the second sliding tract sets of the displacement mechanisms to keep the first tool holders of the tool holder panels adjacent to one another so that the traveling distance of the tool holder panels can be minimized.

Further, one second tool holder of one tool holder panel is disposed in parallel to one adjacent second tool holder of another adjacent tool holder panel.

DETAILED DESCRIPTION OF THE PREFERRED EMBODIMENT

Figure 1:
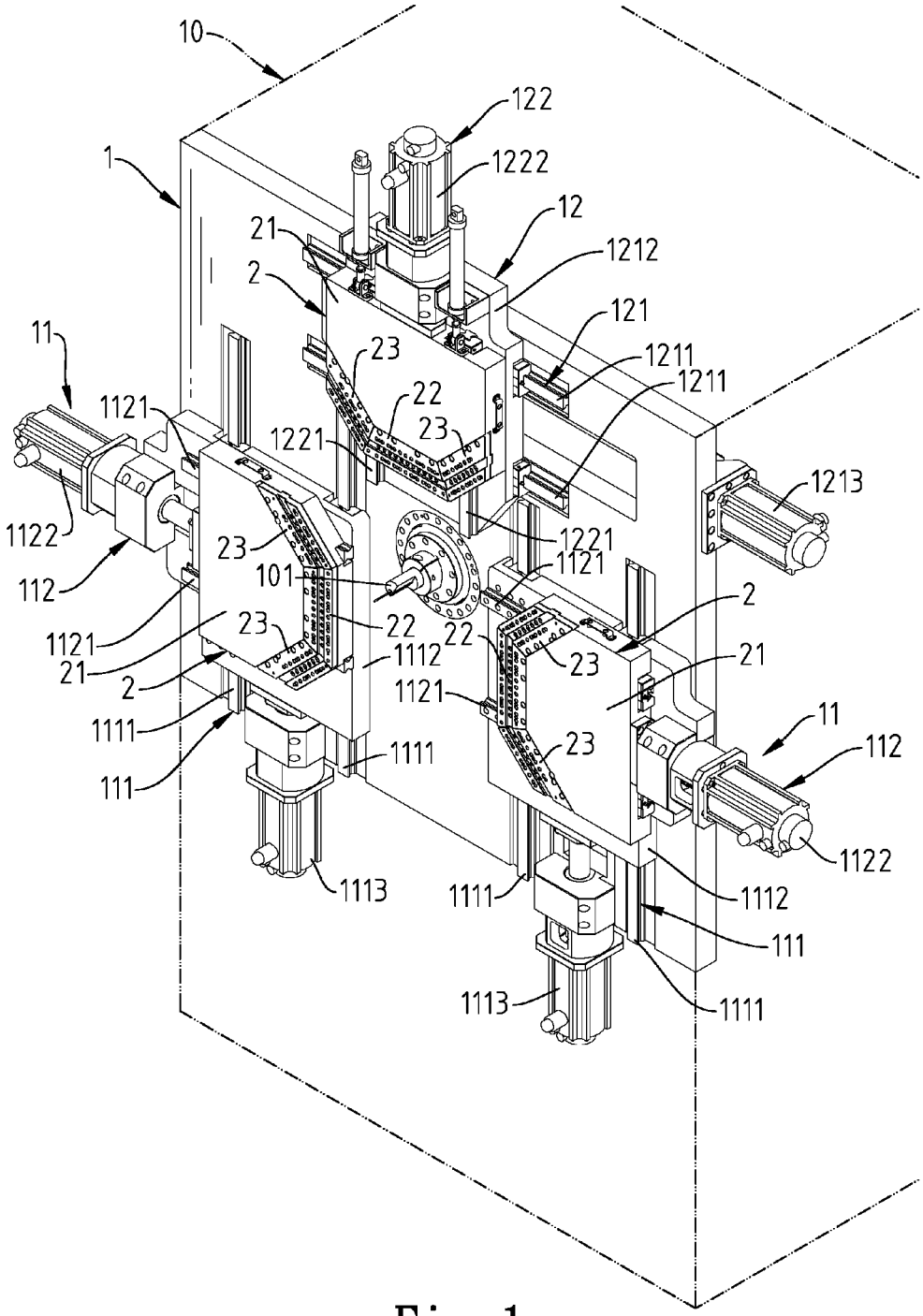
FIG. 1 is an oblique top elevational view, illustrating a tool holder configuration structure installed in a spring making machine in accordance with the present invention.
Figure 2:
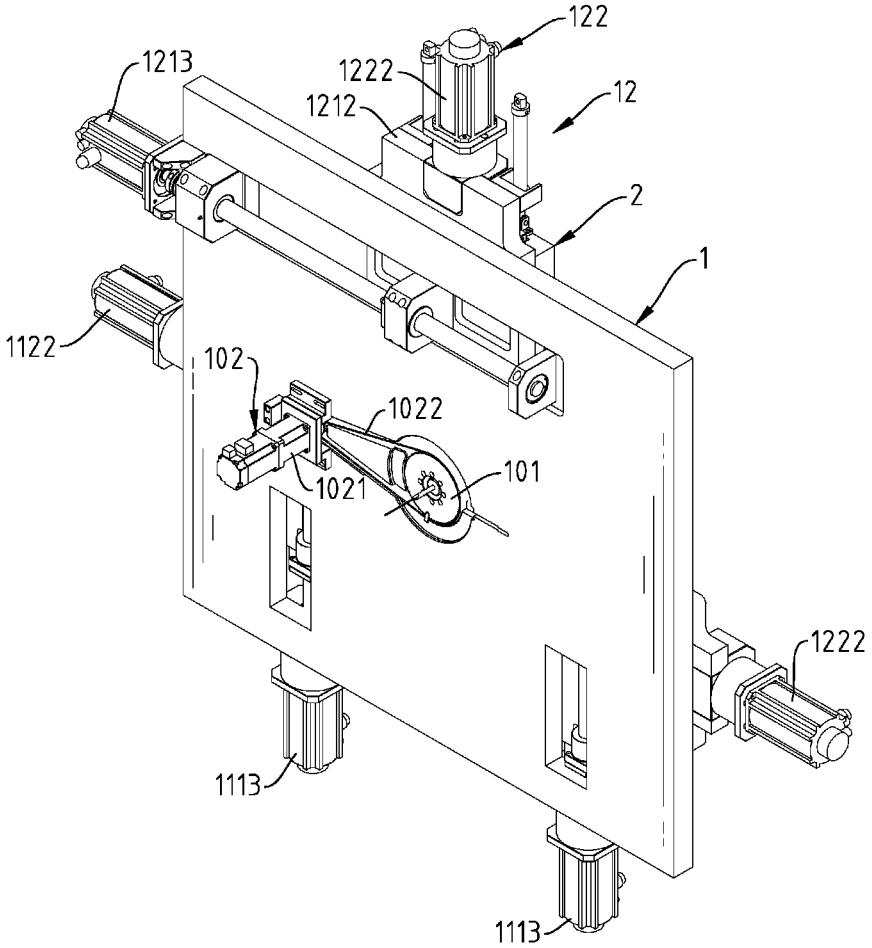
FIG. 2 is an oblique elevational view of a part of the spring making machine shown in FIG. 1.

Referring to FIGS. 1 and 2, a tool holder configuration structure in accordance with the present invention is shown used in a spring making machine that comprises a machine body 10 having mounted thereon a wire guide 101 and a rotator 102. The rotator 102 comprises a servo motor 1021, and a transmission belt 1022 coupled between the servo motor 1021 and the wire guide 101 and driven by the servo motor 1021 to rotate the wire guide 101 within a predetermined angle. The machine body 10 further comprises a power system, a central processing unit, a control system, power drive means, transmission means, etc. As the machine body 10 is not in the scope of the present invention, no further detailed description in this regard will be necessary.

Figure 3:
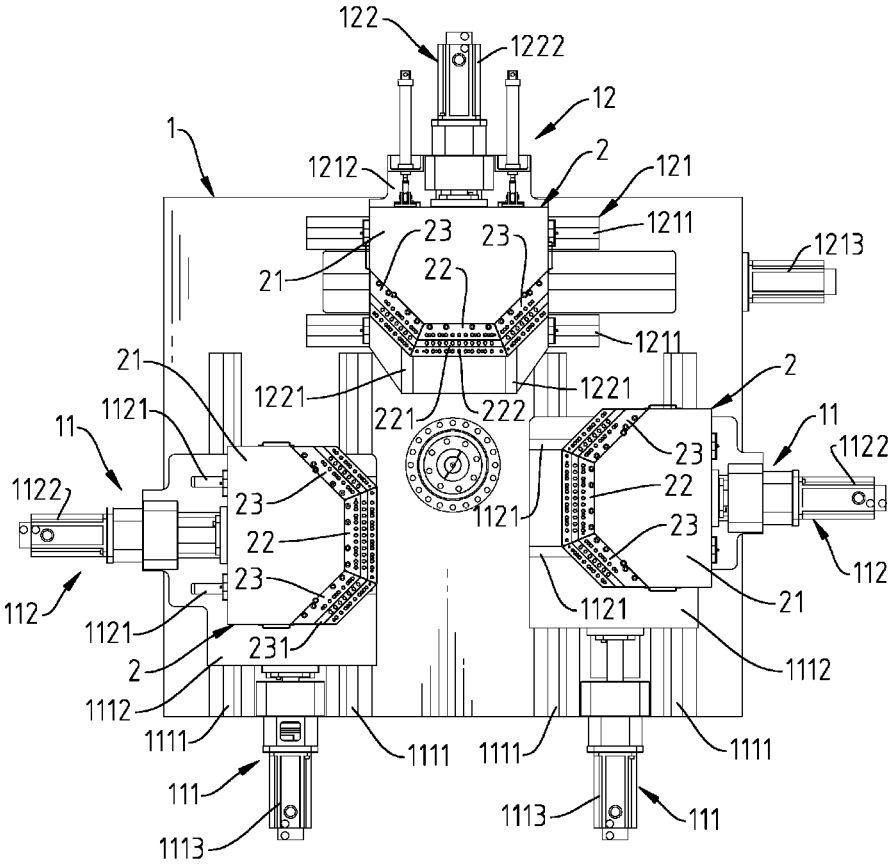
FIG. 3 is a front view of the tool holder configuration structure in accordance with the present invention.
Figure 4:
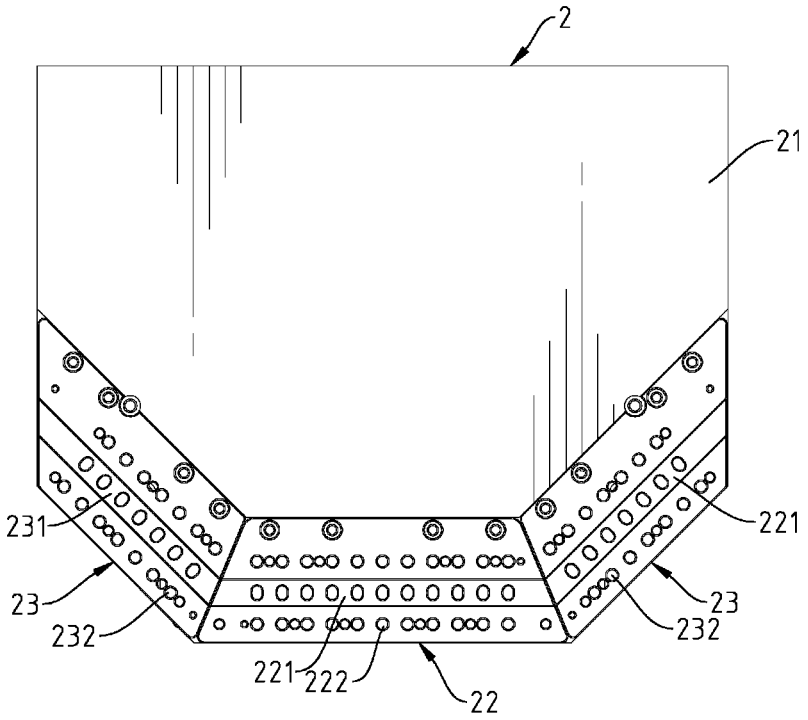
FIG. 4 is a front view of one tool holder panel according to the present invention.

Referring to FIGS. 3 and 4, the tool holder configuration structure comprises a flat base plate 1 and three tool holder panels 2.

The flat base plate 1 comprises three displacement mechanisms (11,12) arranged on a front side thereof in a triangle with two displacement mechanisms 11 arranged at two opposite lateral sides to face each other and the other displacement mechanism 12 arranged at a top side and equally spaced from the two lateral displacement mechanisms 11. The displacement mechanism (11,12) each comprise a first sliding tract set (111,121), and a second sliding tract set (112,122) connected to the first sliding tract set (111,121). The first sliding tract set (111,121) comprises a first rail track (1111,1211), a displacement board (1112, 1212) slidably mounted on the first rail track (1111,1211), and a first driver (1113,1213) disposed at one side relative to the first rail track (1111,1211) and coupled with the displacement board (1112,1212) and controllable to move the displacement board (1112,1212) alternatively forward and backward along the first rail track (1111,1211). The second sliding tract set (112,122) comprises a second rail track (1121,1221) mounted on the displacement board (1112, 1212) in a direction perpendicular to the extending direction of the first rail track (1111,1211), and a second driver (1122,1222) disposed at one side relative to the second rail track (1121,1221).

Each tool holder panel 2 comprises a base 21, a first tool holder 22 located on one side of the base 21, and two second tool holders 23 located on the base 21 at two opposite lateral sides of the first tool holder 22 in an oblique manner and respectively defining with the first tool holder 22 a contained angle of 135 degrees. The first tool holder 22 comprises a plurality of first positioning grooves 221, and a plurality of first positioning holes 222 disposed in each first positioning groove 221. Each second tool holder 2 comprises a plurality of second positioning grooves 231, and a plurality of second positioning holes 232 disposed in each second positioning groove 231. Further, these three tool holder panels 2 are respectively coupled to the second rail tracks (1121,1221) of the aforesaid three displacement mechanisms (11,12). Since the first tool holders 22 of the three tool holder panels 2 are disposed in a triangle and the second tool holders 23 of each tool holder panel 2 respectively define with the associated first tool holder 22 a contained angle of 135 degrees, the adjacent second tool holders 23 of each two adjacent tool holder panels 2 are kept in parallel. Further, the opposite side of the base 21 of each tool holder panel 2 remote from the associated first tool holder 22 is connected to the second driver (1122,1222) of the second sliding tract set (112,122) of one respective displacement mechanism (11,12) so that the respective second drivers (1122,1222) can be controlled to move the respective tool holder panels 2 alternatively forward and backward along the respective second rail tracks (1121,1221). Thus, the first tool holders 22 of the tool holder panels 2 can be moved close to or away from one another.

Figure 5:
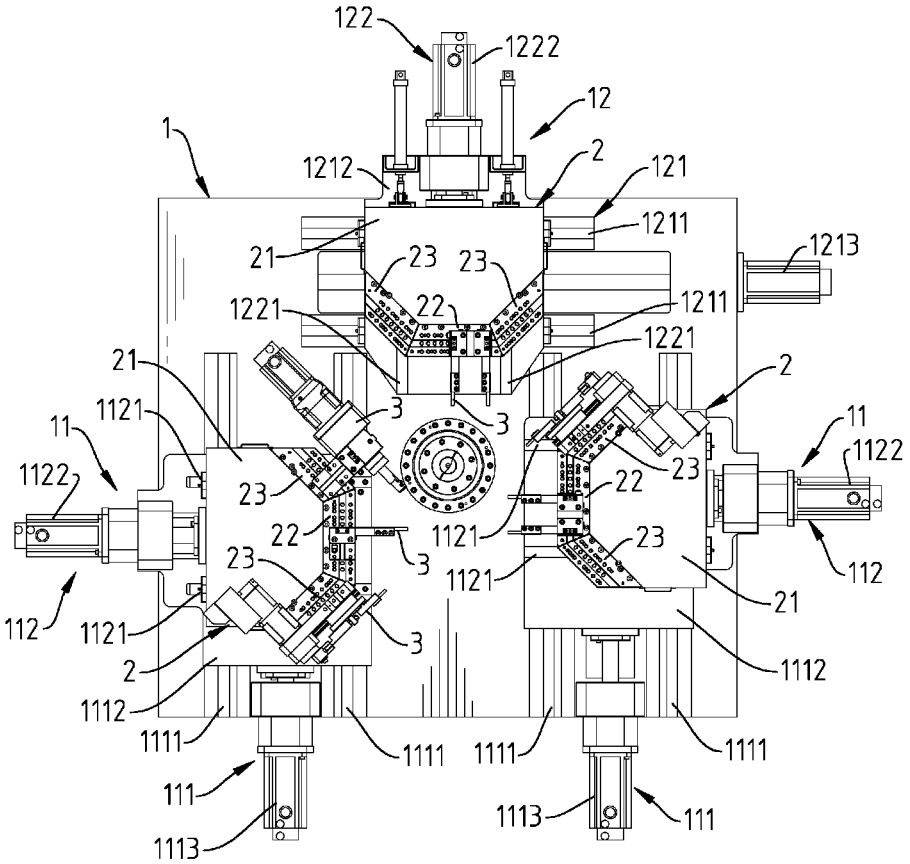
FIG. 5 is a front view of the present invention, illustrating multiple tools installed in tool holder panels.
Figure 6:
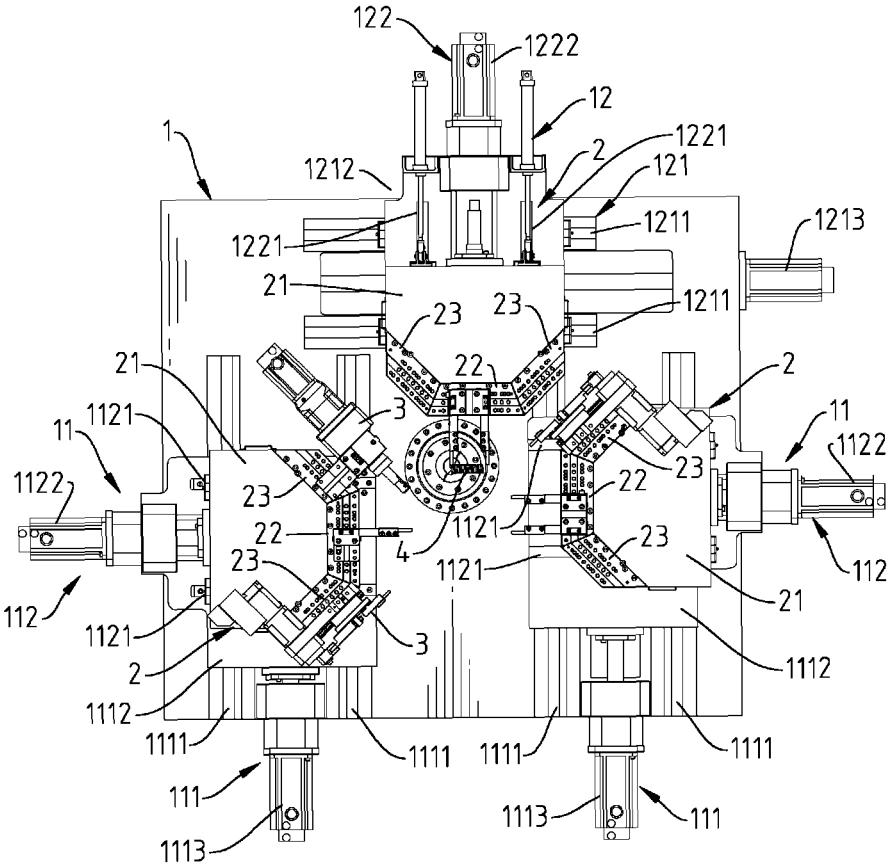
FIG. 6 corresponds to FIG. 5, illustrating the tool holder panels moved relative one another.

Referring to FIGS. 3-6 and more particularly to FIG. 5, since the second tool holders 23 of the tool holder panels 2 are respectively disposed in an oblique manner relative to the respective first tool holders 22, the first tool holders 22 and the second tool holders 23 allow installation of a large amount of tools 3 at different angles within the limited surface space of the respective tool holder panels 2. Further, when tools 3 are mounted in the first positioning holes 222 of the first tool holders 22, the loaded tools 3 face toward a first direction. Further, the first positioning grooves 221 face toward a second direction different from the first direction. Further, as illustrated in FIG. 6, the tools 3 each have a variety of different functions including guiding, positioning, rotating, bending and cutting, and are movable by the respective tool holder panels 2. Further, the tool holder panels 2 are movable by the respective displacement mechanisms (11,12). Thus, the loaded tools 3 can be moved subject to the control of a predetermined software program to process a metal wire into the desired springs 4. Since the tool holder configuration structure of the present invention provides three displacement mechanisms (11,12) and three tool holder panels 2. Thus, when one tool holder panel 2 completed the processing operation, the tool holder panels 2 are moved at the same time, feeding one tool 3 into the processing position and simultaneously retracting another tool 3 away from the processing position, and thus, the tool feeding and retracting operation can be greatly accelerated. Further, because the second tool holder 23 one tool holder panel 2 is disposed in parallel to one adjacent second tool holder 23 of another adjacent tool holder panel 2, each two adjacent tool holder panels 2 are disposed close to each other, and the traveling distance of the minimizing the tool holder panels 2 can be significantly reduced.

What the invention claimed is:

1. A tool holder configuration structure used in a spring making machine, comprising:

a flat base plate comprising three displacement mechanisms arranged on a front side thereof in a triangle, each said displacement mechanism comprising a first sliding tract set and a second sliding tract set connected to said first sliding tract set at right angles, two said displacement mechanisms of said three displacement mechanisms being arranged at two opposite lateral sides to face each other, the other said displacement mechanism of said three displacement mechanisms being arranged at a top side and equally spaced from the two laterally arranged said displacement mechanisms; and three tool holder panels, each said tool holder panel comprising a base, a first tool holder located on one side of said base and two second tool holders located on said base at two opposite lateral sides of said first tool holder are oblique relative to said first tool holder, said tool holder panels being respectively coupled to said second sliding tract sets of said displacement mechanisms to keep said first tool holders of said tool holder panels adjacent to one another.

2. The tool holder configuration structure as claimed in claim 1, wherein one said second tool holder of one said tool holder panel is disposed in parallel to one adjacent said second tool holder of another adjacent said tool holder panel.

3. The tool holder configuration structure as claimed in claim 1, wherein said first tool holder of each said tool holder panel comprises a plurality of first positioning grooves, and a plurality of first positioning holes disposed in each said first positioning groove for the mounting of respective tools.

4. The tool holder configuration structure as claimed in claim 1, wherein each said second tool holder of each said tool holder panel comprises a plurality of second positioning grooves, and a plurality of second positioning holes disposed in each said second positioning groove for the mounting of respective tools.

* * * * *